United States Patent [19]

Vukoje

[11] 4,103,481

[45] Aug. 1, 1978

[54] VARIABLE DIAMETER YARN

[75] Inventor: Tatjana Vukoje, Dusseldorf, Fed. Rep. of Germany

[73] Assignee: Akzona Incorporated, Asheville, N.C.

[21] Appl. No.: 783,279

[22] Filed: Mar. 31, 1977

Related U.S. Application Data

[62] Division of Ser. No. 555,900, Mar. 6, 1975, Pat. No. 4,033,103.

[30] Foreign Application Priority Data

Mar. 8, 1974 [DE] Fed. Rep. of Germany ..... 2411074

[51] Int. Cl.[2] ..... D02G 3/26; D02G 3/34

[52] U.S. Cl. ..... 57/140 J; 57/157 TS

[58] Field of Search ..... 57/140 J, 157 TS

[56] References Cited

U.S. PATENT DOCUMENTS

| | | | |
|---|---|---|---|
| 3,977,173 | 8/1976 | Kosaka et al. | 57/140 J |
| 3,978,647 | 9/1976 | Kosaka et al. | 57/157 TS X |

*Primary Examiner*—Richard C. Queisser
*Assistant Examiner*—Charles Gorenstein
*Attorney, Agent, or Firm*—Keil, Thompson & Shurtleff

[57] ABSTRACT

A variable diameter "thick-thin" effect yarn having a characteristically long thin twisted segment of low voluminosity in which the twist alternates to run first in one S- or Z-direction and then reverses over a zero twist point to run in the opposite direction, said twisted segment of the yarn alternating with a thick or bulky and substantially non-twisted, false twist texturized segment of high voluminosity. The process and apparatus for producing this effect yarn are also described in detail.

10 Claims, 7 Drawing Figures

FIG. 1
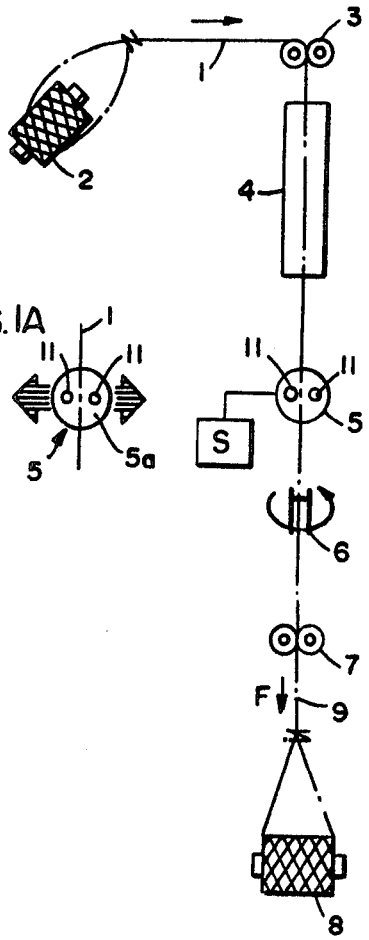
FIG. 1A
FIG. 2
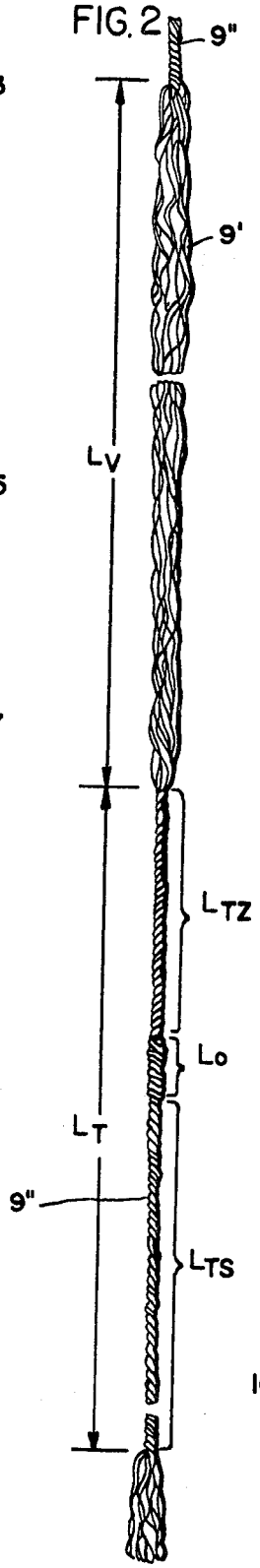
FIG. 3
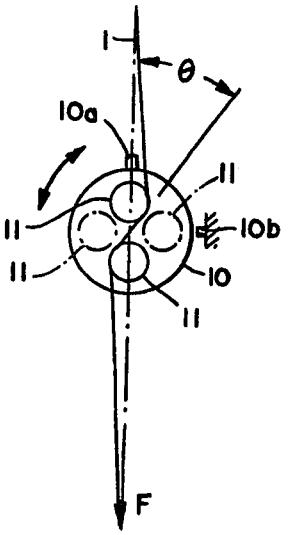
FIG. 4
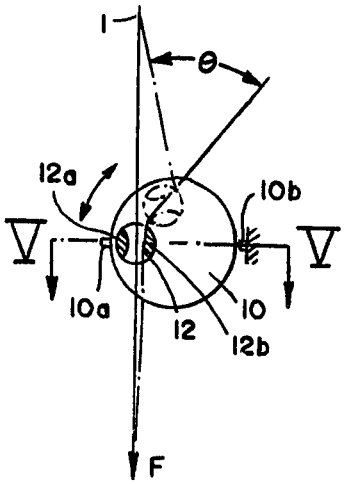
FIG. 6
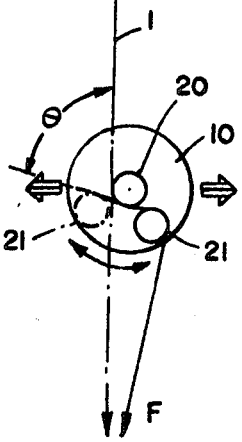
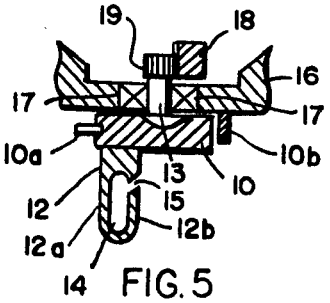
FIG. 5

VARIABLE DIAMETER YARN

This is a division, of application Ser. No. 555,900, filed Mar. 6, 1975, now U.S. Pat. No. 4,033,103.

For the production of texture accented fabrics such as "Douppion" or "Honan" fabrics, which are distinguished by the formation of stripes in the warp and/or the weft as well as by burls or nubby and cloud-like patterns, the synthetic fiber industry makes available so-called "effect yarns" which may also be referred to as "fancy" or "novelty" yarns. These effect yarns exhibit alternating thick and thin portions, preferably voluminous and less voluminous portions or points over the length of a continuous multifilament yarn. These alternating portions may appear in a uniform or nonuniform manner. Such effect yarns with thick and thin portions or alternating variations in bulk or voluminosity may be referred to as "variable diameter" yarns or "thick-thin" threads or yarns with or without uniformity in the manner in which the denier varies over the length of the yarn.

In order to achieve such thick-thin threads or yarns, the spun titer or yarn size may be varied through irregular changes of the spinning speed, i.e. the rate at which the synthetic filaments are initially spun from a fiber-forming synthetic polymer. It is also possible to vary the titer or yarn size over the length of the yarn by changing the amount of stretch applied to the filaments in the development of their fibrous properties. It has also been suggested that a thick-thin yarn be produced in which a voluminous sheath yarn is applied in an irregular manner, i.e. with different concentrations or variable accumulations, along the length of a core yarn having a uniform titer. Such core-sheath yarns or threads may have a variety of structures, depending on their formation, but frequently exhibit spaced burls or nodules of the sheath along the core.

The production of a thick-thin yarn or variable diameter yarn by using the false twist crimping technique has also been suggested. In general, a filamentary bundle or tow is highly twisted to a certain extent, the turns or twists are fixed (usually by a heat treatment) and the resulting twisted and fixed filamentary bundle is then back-twisted to the same extent as the original twist, i.e. twisted in the opposite direction to provide an untwisted texturized yarn, sometimes referred to as a "torque-crimp" yarn.

Thus, one process for the production of yarns with alternating texturized and untexturized portions has been disclosed in U.S. Pat. No. 3,425,206. In this known process, an only partly stretched filamentary bundle as an initial yarn having still unstretched (thick) portions is subjected to a false twist texturizing and is then after-stretched up to the point where the originally unstretched (thick) portions are fully stretched. Thereby, the originally fully stretched (thin) portions of the initial yarn remain crimped or texturized while the original thick portions are drawn out and appear to be practically uncrimped. These intermittently crimped or texturized yarns are then processed into fabrics of the above-mentioned type where the different dyeing of texturized and untexturized yarn portions yields a novel two-toned effect.

From the Japanese Pat. publication No. 36 223/72, it is known that an intermittently crimped yarn with voluminous and nonvoluminous segments or portions can be produced on a false twist crimping apparatus. In this case, an overfeed rate of more than 8% is introduced between the delivery system located before and that located after the false twist zone consisting specifically of the heating device and the false twist assembly. Due to this overfeed, the yarn tension becomes unstable in the heating or so-called fixing zone and the twist slips uncontrollably on and off the false twist spindle. This movement of the twist results in very short "twisted-in" points at which the yarn bundle has scarcely any volume. These "twisted-in" points are previously known from the false twist texturizing process where they are ordinarily produced unintentionally and as an undesirable result as a malfunction of the apparatus or the false twisting process. If adopted as a practice as in the Japanese Patent, this use of an overfeed and the development of short "twisted-in" points does lead to a type of thick-thin yarn, but one cannot use such yarns for producing fabrics having the desired patterned appearance because the thin points are only a few millimeters long and seem to be only flaws in the appearance of the goods rather than a definite pattern.

Another Japanese Pat. publication No. 43 788/72 discloses processes which lead to alternating high and low twisted bulky or puffed yarns by means of irregular variations in the feed and drawoff speeds into and from the false twist zone. In this instance a rather considerable expense is incurred to regulate the process, especially if one wishes to maintain the voluminous and less voluminous portions or sections of the yarn within specified limits of yarn length. Control of the individual lengths of thick and thin portions is of course very important in achieving reproducible yarn and fabric effects.

One object of the present invention is to provide an improved process and apparatus for producing a variable diameter of thick-thin yarn, i.e. an effect yarn having both voluminous and less voluminous portions along its length, by the false twist texturizing under variable tension of a thread bundle consisting essentially of synthetic thermoplastic filaments.

More particularly, it is an object of the present invention to provide such an improved process and apparatus whereby the thick and thin portions of the yarn are carefully regulated in a predetermined manner to achieve an effect yarn in which voluminous three-dimensionally crimped segments alternate with elongated but less voluminous segments having fixed or locked-in twists.

It is a further object of the invention to provide such an improved process and apparatus by the addition of a few simple mechanical parts to each operating position or unit of any conventional false twist texturizing machine, especially in stretch-texturizing machines where the yarn is simultaneously stretched and texturized.

Yet another object of the invention is to provide this improved process and apparatus so as to produce a uniform or nonuniform fluctuation of the yarn tension in the false twist texturizing zone, using the simplest possible technical means but in a highly controlled manner so as to provide effect yarns leading to very desirable patterns or novelty effects.

Still another object of the invention is to provide said improved process and apparatus for the production of thick-thin yarns which can be applied to all filamentary bundles or thread bundles of a fiber-forming polymer whether these bundles are stretched, nonstretched or only partly stretched.

It has now been found, in accordance with the invention, that the foregoing objects are achieved in the generally known false twist texturizing process and apparatus wherein the thread bundle is conducted in a normally linear path between a heating zone or twist-fixing heater and the false twister by adding means for carrying out an additional step of intermittently or periodically deflecting the thread bundle from its normally linear path and shortly before its entry into the false twister by means of a false twist blocking element placed in running contact with the thread bundle. The only additional apparatus required for purposes of the present invention, i.e. in addition to a conventional false twist texturizing machine, is a twist blocking means arranged in the false twist texturizing zone between the false twister and the heater. This twist blocking means must have at least one yarn contacting surface and preferably two yarn contacting surfaces or elements reciprocally movable from a neutral position substantially free of contact with the yarn into a twist blocking position where the yarn contacting surface or surfaces engage the yarn in order to deflect it at an angle sufficient to accumulate twist forwardly in the yarn toward the false twister and subsequently back to said neutral position to release the accumulated back twist of the yarn. This alternating or reciprocating movement of the twist blocking means is accomplished in a controlled manner, preferably by means of a solenoid operated mechanism or the like, so that the desired thick-thin effect can be accurately reproduced on any continuous multi-filament yarn.

The process of the invention is preferably carried out such that the thread bundle being transported through the false twist texturizing zone is twice deflected from its normally linear path by the twist blocking element acting at two contact positions, situated one immediately after the other, the direction of the first yarn deflection being opposite to the direction of the second yarn deflection. The angle of deflection as measured between the two contact positions is preferably between about 90 and 180. In essence the yarn or thread bundle is thus subjected to a controlled intermittent zig-zag deflection which can be imparted at any given time and for any desired length of time.

In order to achieve a good twist blocking or twist accumulating effect with the blocking element, it is preferable to provide yarn contacting surfaces such as deflecting pins or the like as the individual contact positions such that the radius of curvature of the thread bundle in running contact with these surfaces or contact points on the twist blocking element is less than about 1 mm. In general, this ensures the desired intermittent backup accumulation and release of twist as desired at the twist blocking element, especially where the above-noted deflection angle is at least about 90°.

The present invention is of particular value in the generally known stretch-texturizing process and apparatus wherein originally unstretched or only partly stretched filaments are contained in the thread bundle and this thread bundle is drawn off after the false twister at a speed sufficiently high in comparison to the speed of supply of the original yarn that the filaments are substantially completely stretched at about the beginning of the heating zone, i.e. near the entry of the heater.

The generally known false twist texturizing process, sometimes referred to as a "durable torque-crimp" process, and the apparatus employed in this process is well described in the book entitled "Woven Stretch and Textured Fabrics", by Berkeley L. Hathorne, Interscience Publishers, a division of John Wiley & Sons, New York (1964), especially at pages 33 – 59 which are incorporated herein by reference to illustrate the conventional type of false twist texturizing machines. The yarn produced in accordance with the present invention may be further treated for the purposes indicated in Chapter 3 of this same reference entitled "Post-Treated Torque Crimp", for example with the apparatus illustrated on page 69, such subject matter again being incorporated herein by reference.

The term "thick-thin" yarn is generally employed herein to refer to a variable diameter or a variable voluminosity of the yarn between two distinct and characteristic values. While such values may be expressed in quantitative terms, voluminosity will vary over an extremely wide range depending upon the size of the yarn or thread bundle, the individual filament denier, the degree of twist being imparted and similar factors. However, it is possible to achieve an essentially intermittently or discontinuously texturized yarn in the sense that highly twisted and relatively dense segments alternate with lofted or highly bulked and substantially untwisted texturized segments. The new yarns obtained by the process of the invention follow a characteristic pattern or structure imparted by the process in a controlled manner.

The invention is explained in greater detail hereinafter with the aid of the accompanying drawings in which:

FIG. 1 is a schematic illustration of a false twist texturizing machine embodying the essential twist blocking device of the present invention;

FIG. 1*a* is a schematic illustration of the twist blocking device shown in FIG. 1 so as to indicate a lateral reciprocating traversing movement;

FIG. 2 is an enlarged view on a scale of 10:1 of one continuous portion or section of a typical effect yarn produced in accordance with the invention;

FIG. 3 is a front view of one preferred twist blocking device in which a circular reciprocal movement is used for its operation;

FIG. 4 is a front view of another very useful twist blocking device according to the invention using a single slotted pin on a rotatable disk;

FIG. 5 is a cross-sectional view on line V—V of FIG. 4 with the addition of means to mount and means to rotate the twist blocking device; and FIG. 6 is a front view of still another twist blocking device in partly schematic form to illustrate a combined lateral and circular reciprocal movement in its operation.

Referring first to FIG. 1, the process and apparatus of the present invention is incorporated into a false twist texturizing machine or so-called durable torque-crimp machine or so-called durable torque-crimp machine wherein the original untreated yarn or thread bundle 1 runs from the supply bobbin or pirn 2 over a delivery mechanism such as feed rolls into the texturizing zone which essentially includes the heater 4 and the false twister 6. The twist blocking element or device 5 is arranged between the heater 4 and false twister 6, preferably shortly before this false twister, so that the distance over the heater 4 up to the twist blocker 5 is substantially greater than the distance from this twist blocker 5 to the false twister 6. The twist blocking element 5 is shown in its inoperative or neutral position in FIG. 1, i.e. with the thread or yarn running freely through the device and being drawn off by the second delivery mechanism in the form of the draw rolls 7. The treated yarn 9 is subsequently taken up on the spool or winding roll 8.

The blocking device 5, as shown in both FIGS. 1 and 1*a*, may consist of two pins 11 fastened onto a plate 5*a* so as to alternately block and release the thread 1 through a reciprocating traversing movement of the plate running in the horizontal direction as indicated in FIG. 1*a*, for example as actuated by connection to the solenoid operated drive means S shown schematically in FIG. 1. Hydraulically or pneumatically operated drive means are also quite suitable to achieve the desired reciprocal and intermittent movement of the yarn contacting pins 11.

It is preferable, however, as shown in FIG. 3, to impart a rotating or circular pendulum-like reciprocal movement to the plate 10, again using a solenoid drive S or the like, so as to quickly engage or release the running thread at any given time. In FIG. 3, the deflected thread bundle 1 is shown in the form of a heavy unbroken line while the normal linear path of the thread bundle is shown as a broken line extending in the direction F toward the false twister. Mounted on the rotatable disk 10 are two contact pins 11 which are in an operatively engaged position in running contact with the yarn to provide a zig-zag deflection; the inoperative or neutral position of these pins is indicated in broken lines. The deflection angle $\theta$, measured as between the first and second contact pins, should preferably fall within a range of about 90° and 180°. The deflection angles generally shown in the drawing are less than 90° to make the illustration of this angle clearer, it being understood that this smaller angle then also indicates a position somewhere between the fully operative deflected position and the neutral or open position.

The turning angle of the disk 10 is not identical to the deflection angle $\theta$ but will ordinarily be somewhat larger than this deflection angle. Thus, as shown in FIGS. 3 and 4, the rotational movement of the plate 10 by about 90° produces a deflection angle of less than 90°. When the disk 10 is rotated by about 180°, for example where the radially projecting rod or finger 10*a* is brought around into contact with the fixed stop member 10*b*, then the resulting angle of deflection $\theta$ will generally exceed 90° so as to be in the preferred working range of the deflection angle.

FIGS. 4 and 5 illustrate another preferred embodiment of the twist blocking device using a yarn contacting element 12 in the form of a hookeye thread guide which is mounted eccentrically to the axis of rotation 13 of the carrier disk 12. The thread bundle 1 runs through the eye 14 of the guide member 12 towards the outer end thereof after being introduced through slot 15. As shown in FIG. 4 the guide 12 is in the open or neutral position with the thread remaining free of contact without blocking or accumulating twist in the yarn. If the disk 10 is then rotated in clockwise direction to bring the guide 12 into the position indicated by broken lines, then the thread 1 is brought into contact with both flanks forming the eye of the guide to produce the angle of deflection $\theta$. By further clockwise rotation until finger 10*a* is stopped by fixed member 10*b*, there is achieved a relatively large angle $\theta$ of more than 90° as the thread zig-zags down around one flank 12*a* and then up and over the other flank 12*b* of the single guide member.

The single hookeye guide 12 may also be arranged concentrically on the disk axis 13, i.e. so that the eye 14 is centered on this axis. The twist blocking effect upon rotation of the guide 12 is then initiated much more rapidly and with the incoming and outgoing thread 1 being only slightly displaced from its normal linear path extending backwardly to the heater and forwardly to the false twister.

The inner and outer yarn contacting surfaces of the guide 12 are preferably rounded, again with a small but still gradual radius of curvature of less than 1 mm. over at least part of the curved contact path, e.g. in going from the outer circumferential surface of the guide to the inner surface of its eye. The flanks 12*a* and 12*b* may also be in the form of substantially cylindrical rods fitted into the disk 10 either separately or on their own base stub.

As illustrated in FIG. 5, the rotation of disk 10 which is mounted by shaft 13 on frame 16 by means of the bearings 17, can be effected by means of the rack 18 driving pinion 19, the solenoid or similar actuating device of FIG. 1 being operatively connected to the rack 18. Thus, the disk 10 rotates until finger 10*a* contacts the stop 10*b*, or in most cases, it will be preferable to provide a suitable limiting movement of the rack 18 or its actuating member so that the prescribed amount of rotation can be carefully set for any particular false twist texturizing operation.

Another double pin twist blocking device is shown in FIG. 6 where the disk 10 carries a first pin 20 on the axis of rotation of the disk, e.g. as a forward extension of shaft 13 as presented in FIG. 5. A second eccentrically positioned deflecting pin 21 can be located in the first neutral position shown in broken lines for rotation in a counterclockwise direction to the illustrated operative position shown in solid lines with the angle $\theta$ being approximately 90°. In this instance, one can maintain the incoming or the outgoing thread bundle 1 exactly along the normal linear path. Moreover, by further combining a reciprocal lateral movement of the disk is indicated by the horizontal arrows, one can carefully adjust the lateral positions of both pins 20 and 21. If FIG. 6 is viewed upside down with the thread 1 running opposite to the direction F, then a very similar result is achieved with a linear feed into the false twister always being maintained.

The yarn contacting surfaces of the various deflecting pins or guides can be made of known materials such as oxide ceramics or the like. An especially good effect is achieved with metallic contact elements where at least the yarn contacting surfaces have been dull chromed. Such wear resistant surfaces are commonly used in this art and become especially important when operating at high yarn speeds.

The treated yarn 9, after leaving the texturizing zone and being drawn off at 7 to be collected on the winding spool 8, can have the typical appearance given by way of example in FIG. 2 in an enlarged scale of 10:1. This product yarn 9 has one texturized, voluminous segment or length 9′ followed by another almost equal length 9″ in which the yarn is twisted and of substantially less voluminosity. The length of the voluminous segment is designated as $L_V$ while the less voluminous segment is designated as $L_T$. This latter twisted segment $L_T$ has a particular structure or configuration as explained more fully below.

In carrying out the false twist texturizing and twist blocking procedure of the present invention, one can generally employ any conventional false twist machinery where the yarn is conducted continuously through a heater or a so-called heat setting or fixing device and then through the false twister to run a twist back into the heat setting zone. Conventional tensioning and/or twist stopping means preceding the heater may also be used as well as various thread guides or fixed pins defining the overall path of the transported thread through the machine. The type of heater or fixing device is of equal importance with the type of false twist assembly being used to achieve a known texturizing effect. For example one can use hot air boxes, heated beams or plates or similar heaters including those with grooved slots or channels. The false twist assembly may be widely selected from those available in this art, including preferably a false twist spindle having a friction pin or roller (Diabolo) inserted transversely to the axis of rotation within the hollow rotatable spindle. Frictional false twist devices of various types are also suitable and can lead to very interesting side effects for a novelty yarn in spite of the controlled thread slippage achieved with the present invention. Again, one may refer to the Hathorne book cited above or similar references for useful false twist machines.

The addition of the twist blocking device to the known apparatus does cause variations in the thread tension when placed in running contact with the yarn or thread bundle. However, in comparison to the processes suggested in the above noted Japanese published Pat. No. 36 223/72, the process of the present invention produces changes in thread tension over a longer period and in a highly controlled manner.

Moreover, the twist blocking effect of the present invention occurs between the false twister and the heater and results in the false twist being accumulated in front of this blocking device, i.e. so that the normal false twist present without the blocking device is quickly backed up or accumulated in the thread between the false twister and the twist blocker. It will thus be observed in placing the twist blocker into operation that the number of twists per unit length between the blocker and the false twister is substantially greater than that of the thread bundle when running freely from the heater to the false twister.

At the same time, when the twist blocker is acting on the thread in accordance with the invention, the number of twists or turns per unit length between this blocker up to the false twister is substantially higher than with the normally running false twisted thread. When this "overtwisted" portion of the blocked thread passes through the false twister, it receives a number of untwisting turns per meter which are fewer than its own twist so as to retain a portion of true heat-set twist. In effect, the thread has accumulated a true twist in the direction imparted by the false twister and a "normal" or "true" heat-set twist, for example an S-twist as indicated at $L_{TS}$ of FIG. 2, is produced in the yarn. Meanwhile, the thread extending back to the heater from the twist blocker has a fewer number of turns per meter than that imparted by the false twister.

When the blocking device is moved back into its neutral position so as to be free of running contact with the thread, next portion of the thread with a fewer number of turns per meter runs forwardly through the false twister, and it thereby given an "overtwist". Since the thread bundle at this precise moment has a fewer number of turns per unit length than during normal operation, the twist is reverse twisted past its neutral or zero-point in passing over the false twister to produce a "reverse twist" portion $L_{TZ}$ of the thread as shown in Fig 2, i.e., this time as a Z-twist. Between the S-twisted portion $L_{TZ}$ and the Z-twisted portion $L_{TZ}$ of the resulting length of yarn 9", there occurs a more or less distinct point of zero rotation $L_O$ which exhibits a very slightly larger volume or diameter than the twisted-in portions $L_{TS}$ and $L_{TZ}$ on either side thereof. These portions $L_{TS}$ and $L_{TZ}$ of opposite twist direction do not become untwisted because the overtwisted $L_{TS}$ portion retains a sufficiently heat-set twist to resist being untwisted by the $L_{TZ}$ portion having an opposite twist which is not heat-set.

In the preferred operation of the twist blocking device of the invention, the accumulation or backing up of the twist between the false twister and the blocking device and its sudden release can be carried out in a relatively uniform manner in the sense that the twisted-in or thin length $L_T$ has approximately the same length and is incorporated at regular intervals. Moreover, the portions $L_{TS}$ and $L_{TZ}$ can be made approximately equal in length. Moreover, the thin, non-voluminous lengths $L_T$ can be extended far beyond 1 cm. in length, e.g. preferably at least about 2 cm. in length or more, so that clearly defined patterns can be achieved with the finished effect yarn. At the same time, one can also provide highly irregular twisted-in or thin portions $L_T$, both as to their position and length but again preferably with $L_T$ being much greater than even the minimum length of about 2 cm., e.g. in a range of about 4–400 cm., preferably about 5–200 cm.

When the initially accumulated twist has passed through the false twister completing the Z-twisted portion $L_{TZ}$, then the yarn or thread bundle runs out of contact with the twist blocking device as in a conventional false twist texturizing operation thereby producing a length $L_V$ of normally texturized, voluminous yarn. These texturized yarn lengths $L_V$ then alternate with the twisted-in lengths $L_T$ according to a predetermined pattern based upon the intermittent activation or operative effect of the twist blocking device.

The lengths of the voluminous or normally texturized portions of the yarn can be very widely controlled because these thick portions $L_V$ will form as long as the twist blocking device is maintained in its neutral or inoperative position. The length of the twisted or thin portions $L_T$, on the other hand, are also very dependent upon the inensity of the blocking action as well as upon the duration of this action. Thus, if there is only a weak or very light blocking action, then the accumulation or backing up of the twist is also very weak so that the thin portions $L_T$ are correspondingly weakly twisted and relatively more voluminous than is a tightly twisted thread. However, if a much stronger blocking action is applied, then the accumulation or damming effect is also much greater so that the thin portions $L_T$ are twisted more strongly and thus much less voluminous.

With an intentionally extra strong and relatively long blocking action, very interesting yarn effects are achieved in spite of the fact that there is also a substantial thread slippage over the blocking element. The above portrayed process then takes place at irregular intervals even within the otherwise "thin portion" of the continuously treated thread. In this case, the constant or less frequently interrupted slippage over the twist blocking means of the apparatus thus tends to create its own irregular variations between thick and thin portions of the yarn, e.g. with the segment $L_O$ tending to expand or to become somewhat longer. The process of the invention thus permits itself to be readily adapted to many variations in the timing and duration of the twist blockage and twist realease, thereby offering a wide variety of novelty yarns in addition to the preferred type of yarn illustrated in FIG. 2.

The deflection of the thread bundle can be effected by a single pin or rod moved into contact with the running yarn either periodically or according to a predetermined program. Preferably, however, the twist blocking device of the invention is constructed as in the illustrated embodiments so that the running thread bundle or yarn is deflected at two points or locations, i.e. at two contact positions, situated one immediately behind the other such that the direction of the first deflection is opposite to that of the second deflection, thereby providing the desired zig-zag deflection with each turn in the zig-zag path preferably given an angle of deflection $\theta$ of at least 90° and preferably less than 180°. This result is easily achieved when the blocking means is constructed as a disk reciprocally turnable on its axis of rotation and having two contact pins mounted thereon at a short interval from each other, either at eccentric positions as in FIG. 3 or with one pin in a central axial position as in FIG. 6. However, it is also quite suitable to provide a single contacting element with a loop-shaped opening or eyelet, e.g. in the form of a hookeyed thread guide member which may also be arranged eccentrically on the rotatable disk carrier or concentrically on its axis of rotation. The means for rotating the disk and/or shifting it in a traversing lateral movement may be provided as shown with a solenoid actuating mechanism or by any other suitable means. Other similar arrangements for a blocking means may also be readily adopted as long as the yarn contacting elements produce at least two opposing deflections with the angle of deflection being at least 90° and with the radius of curvature of the yarn in contact with the blocking means being not more thatn 1 mm.

The thread or yarn delivery means 3 and 7 as shown in FIG. 1 may be operated in a conventional manner such that the draw rolls 7 convey the yarn from the texturizing zone of the apparatus at a rate sufficient to draw off the yarn and impart a positive stretch to the individual filaments as they are supplied by the feed rolls 3 at a correspondingly slower rate of linear speed as unstrretched or only partly stretched filaments. In this way, a substantially complete stretching can take place at about the beginning of the heating zone or. if desired, in a prestretching zone directly before the heat setting or fixing zone being used for the false twist texturizing.

Thus, the present invention is not only applicable to fully stretched filaments or yarns, i.e. wherein fiber properties are fully developed, but it is also very advantageously used with partly stretched or non-stretched filamentary bundles in a single stage or simultaneous stretch-twist-texturizing operation.

Finally, the yarn produced by the invention using the specifically improved process and apparatus may be after-treated in a second fixing or heat-treating step following the false twisting and variable bulking or texturizing procedure, thereby modifying the initially obtained physical properties such as stretch and stability as well as the twist properties. Of course, such modified products depend directly upon first producing the thick-thin yarn of the invention.

The process and apparatus of the present invention may be used for processing yarn sizes of a conventional titer (denier) as ordinarily used in false twist texturizing operations, and the yarns may be composed of any of the usual thermoplastic fiber-forming polymers such as the nylons including polycaprolactam and polyhexamethylenediamine adipate, the linear polyesters such as polyethylene terephthalate or other dry or wet spun thermoplastic filamentary materials such as polyacrylonitrile.

The invention is further illustrated by the following working examples.

EXAMPLE 1

A thread bundle composed of polyethylene terephthalate filaments being melt spun at the rate of 2,000 meters/minute to provide an initial yarn of 360 dtex and 30 individual filaments is treated om a stretch-texturizing machine as schematically shown in FIG. 1. The feed rolls 3 operate at a linear thread speed of 73 meters/minute while the draw rolls 7 operate at 171.5 meters/minute in order to stretch the yarn with a feed:draw ratio of about 1:2.35. The heating device 4 is a rail heater maintained at a temperature of about 230° C. With the false twister operated at spindle rate of rotation of 378,000 r.p.m., there are about an average of 2204 turns per meter introduced into the thread bundle. The twist blocking device 5 as shown in FIG. 1 is arranged about 2.5 cm. in front of the false twist assembly 6 and is used to block the thread bundle about 40 times per minute at an angle of deflection $\theta$ of approximately 170°. On the average, the length $L_V$ of the thick or normally texturized voluminous portion of the yarn amounts to about 108 cm. while the length of the thin twisted portions $L_T$ amounts to about 88 cm.

EXAMPLE 2

The procedure of Example 1 is again followed but with the number of twist blockings being reduced to 16 per minute. In addition, the blocking was carried out using only one pin 12 as shown in FIGS. 4 and 5. The length $L_V$ in this case is about the same as the length $L_T$ and both vary somewhat between about 2 meters and 3.50 meters.

EXAMPLE 3

Again following the procedure of Example 1 with the use of two blocking pins, the angle of deflection is reduced to about 50° with the number of twist blockings increased to about 90 per minute. The lengths $L_V$ and $L_T$ fluctuate but amount to about 40 to 45 cm.

Similar results are achieved with many other yarns, including nylon and polyacrylonitrile yarns of various sizes and with or without a prior stretching in the false twist machine. It is particularly useful to achieve the yarn of the preceding examples with the paricular structure shown in FIG. 2 wherein the thin segments $L_T$ are quite long and have the characteristic twist reversal, e.g. from an S-twist length $L_{TS}$ to a Z-twist length $L_{TZ}$ joined by a relatively short detwisted length $L_O$. Although the minimum length of the thin twisted segment is preferably at least about 2 cm. and usually at least 5–10 cm. or more, it may be easily extended up to 400 cm. or even more. The length of the thick or normally texturized portion can of course be extended as far as desired by maintaining the twist blocking means out of operation. However, it is especially preferred to achieve about equally long thick and thin lengths of yarn, e.g. in a range of about 1.5:1 to 1:1.5 or more preferably about 1.2:1 to 1:1.2. Excellent patterned effects can be achieved with such a novelty or effect yarn.

The invention is hereby claimed as follows:

1. A variable diameter "thick-thin" effect yarn having a substantially non-twisted, voluminous, false twist texturized segment as the "thick" portion of the yarn alternating with a less voluminous twisted segment as the "thin" portion of the yarn in which the twist alternates to first run in one S- or Z- direction and then reverses over a zero twist point to run in the opposite direction.

2. An effect yarn as claimed in claim 1 wherein the non-twisted, voluminous, texturized "thick" segment has approximately the same length as the less voluminous, twisted "thin" segment.

3. An effect yarn as claimed in claim 1 wherein the ratio of the length of the non-twisted, voluminous, texturized "thick" segment to the less voluminous, twisted "thin" segment is about 1.5:1 to 1:1.5.

4. An effect yarn as claimed in claim 1 wherein the less voluminous, twisted "thin" segment has a total length of at least about 2 cm.

5. An effect yarn as claimed in claim 1 wherein the less voluminous, twisted "thin" segment has a total length of about 4 to 400 cm.

6. An effect yarn as claimed in claim 5 wherein the ratio of the length of the non-twisted, voluminous, texturized "thick" segment to the less voluminous, twisted "thin" segment is about 1.5:1 to 1:1.5.

7. An effect yarn as claimed in claim 6 wherein said ratio is about 1.2:1 to 1:1.2.

8. An effect yarn as claimed in claim 5 wherein the less voluminous, twisted "thin" segment has a total length of about 5 to 200 cm.

9. An effect yarn as claimed in claim 8 wherein the ratio of the length of the non-twisted, voluminous, texturized "thick" segment to the less voluminous, twisted "thin" segment is about 1.5:1 to 1:1.5.

10. An effect yarn as claimed in claim 9 wherein said ratio is about 1.2:1 to 1:1.2.

* * * * *